US005890340A

United States Patent [19]

Kafarowski

[11] Patent Number: 5,890,340

[45] Date of Patent: Apr. 6, 1999

[54] CONCRETE INSERT FOR ATTACHING WALL PANELS TO BUILDING STRUCTURES

[76] Inventor: Zygmunt Grant Kafarowski, P.O. Box 149, 523 Bowes Rd., Concord, Ontario, Canada, L4K 1B2

[21] Appl. No.: 705,275

[22] Filed: Aug. 29, 1996

[51] Int. Cl.[6] ..... E04B 1/41

[52] U.S. Cl. ..... 52/704; 52/698; 52/707; 52/708; 52/712; 52/99; 52/100; 52/127.3; 52/710

[58] Field of Search ..... 52/235, 698, 704, 52/706, 707, 708, 709, 710, 711, 712, 383, 100, 99, 127.3, 127.4

[56] References Cited

U.S. PATENT DOCUMENTS

| | | | |
|---|---|---|---|
| 774,441 | 11/1904 | Luck | 52/698 X |
| 806,027 | 11/1905 | Vance | 52/704 X |
| 984,647 | 2/1911 | Carlson . | |
| 1,089,874 | 3/1914 | Smith . | |
| 1,136,460 | 4/1915 | Wright . | |
| 1,260,331 | 3/1918 | Collings | 52/707 X |
| 1,409,524 | 3/1922 | Chase | 52/711 |
| 1,474,729 | 11/1923 | Ogden | 52/708 X |
| 1,484,053 | 2/1924 | Bayley | 52/704 |
| 1,922,479 | 8/1933 | Joslin | 52/699 X |
| 1,933,536 | 11/1933 | Awbrey . | |
| 2,165,882 | 7/1939 | Birch | 52/706 |
| 2,181,740 | 11/1939 | Reiland . | |
| 2,780,936 | 2/1957 | Hillberg | 52/698 X |
| 3,004,638 | 10/1961 | Eaton . | |
| 3,005,292 | 10/1961 | Reiland | 52/99 |
| 3,620,277 | 11/1971 | Tummarello . | |
| 4,040,228 | 8/1977 | Skubic . | |
| 4,085,556 | 4/1978 | Sonneville | 52/707 X |
| 4,130,977 | 12/1978 | Taylor, Jr. et al. . | |
| 4,194,333 | 3/1980 | Paton et al. . | |
| 4,412,407 | 11/1983 | Melfi et al. | 52/707 X |
| 4,532,740 | 8/1985 | Fricker . | |
| 4,768,322 | 9/1988 | Kafarowski . | |
| 4,774,791 | 10/1988 | Kafarowski . | |
| 4,905,444 | 3/1990 | Semaan et al. . | |
| 5,357,721 | 10/1994 | Alverez | 52/710 X |

FOREIGN PATENT DOCUMENTS

| | | | |
|---|---|---|---|
| 1112071 | 11/1981 | Canada . | |
| 2447365 | 4/1976 | Germany | 52/710 |
| 22045 | 9/1958 | Ireland . | |
| 399581 | 10/1933 | United Kingdom | 52/709 |
| 1013217 | 12/1965 | United Kingdom | 52/710 |

OTHER PUBLICATIONS

"Heckamnn Masonry Tires & Anchors" Brochure, p. M2, Heckmann Building Products Inc., 1995.

Brochure entitled "PSA Slotted Inserts for Pre–Cast Concrete Panel Connections", date unknown, 2 pages.

Brochure entitled "PSA Slotted Inserts, The New Low Cost—High Capacity Insert", date unknown, 3 pages.

Brochure entitled "Corewall® Slotted Inserts with New Plastic Slot Cover", date unknown, 4 pages.

*Primary Examiner*—Carl D. Friedman
*Assistant Examiner*—Laura A. Callo
*Attorney, Agent, or Firm*—Riches, McKenzie & Herbert

[57] ABSTRACT

Concrete inserts are disclosed which are preferably embedded in the rear surface of a concrete wall panel and used to mount and support the wall panel from a building frame. The insert preferably comprises a U-shaped metal housing defining a longitudinally extending channel, the housing comprising two side members in spaced, facing relation to one another and a bight portion between the side members, the bight portion having a longitudinally extending slot therethrough. The insert is adapted to be embedded in the rear surface of the wall panel with the bight portion flush with the rear surface and the side members embedded in the concrete of the panel. The side members are preferably of a trapezoidal shape which provides the insert with high resistance to withdrawal from the concrete. The concrete insert preferably has a nut received in a concrete-free chamber beneath the opening in the bight portion, a single piece of foam plastic preferably being used to retain the nut in position and prevent liquid concrete from entering the concrete-free chamber during casting of the wall panel.

26 Claims, 3 Drawing Sheets

CONCRETE INSERT FOR ATTACHING WALL PANELS TO BUILDING STRUCTURES

FIELD THE INVENTION

This invention relates to an improved concrete insert for attaching precast concrete wall panels to the structural frames of building structures.

BACKGROUND OF THE INVENTION

In modern building construction techniques, it is typical to provide a strength providing building frame, on the outside of which is mounted a curtain wall comprising panels typically made of glass, stone, synthetic stone or precast concrete. These curtain walls and the panels comprising them typically are not load bearing members and are "hung" from the building frame such that their weight is substantially supported by the building frame.

The panels are large and heavy and are generally fabricated with mounting attachments incorporated or embedded in them so that the panels can be attached to the building frame by means of bolts or other fasteners.

In particular, wall panels cast from concrete or other cementitious materials typically have concrete inserts made of steel embedded in their rear surfaces during the casting process, the concrete inserts being spaced from one another and sufficient in number to substantially resist lateral forces acting on the panel when the panel incorporating the inserts is connected to the building frame.

Typical concrete inserts comprise an elongate metal housing having a top surface to be mounted flush with the rear surface of a wall panel and a plurality of side members to extend downwardly into the concrete wall panel. The top surface of the metal housing is usually provided with an elongate, longitudinal opening, below which is received a nut in a concrete free space. The panel may for example be bolted to a structural member of a building frame by inserting the shaft of a bolt through the longitudinal opening to engage the nut in the concrete free space.

Typically, the concrete free space extends most of the length of the longitudinal opening so that the nut is slidable along the opening. Slidability of the nut along the opening helps to prevent damaging stresses from developing in the panel due to thermal expansion and contraction of the concrete panel relative to the building frame, and changes in the shape of the building structure caused by seismic activity or wind.

As may be appreciated, a concrete insert must be securely embedded in the concrete of the wall panel so that the insert cannot be withdrawn from the rear surface of the panel by lateral forces applied to the wall panel or the building structure on which the panel is installed. The ability to resist such forces is to a large extent determined by the shape of the metal housing, and in particular the shape and relative orientation of the side members of the metal housing.

It is known that when a wedge-shaped object having its larger base embedded in concrete is forcibly withdrawn therefrom, the concrete in the vicinity of the object fractures in a conical pattern emanating outwardly from the base of the wedge-shaped object to the surface of the concrete from which the object is withdrawn. The wider the base of the wedge, the larger will be the cone of fracture, and the greater will be the force required to withdraw the wedge-shaped object from the concrete.

This being the case, many concrete inserts are known having wedge-shaped metal housings. For example, U.S. Pat. No. 1,136,460 to Wright and U.S. Pat. No. 1,922,479 to Joslin describe concrete inserts having a cup-shaped metal housing wherein side members extend downwardly from all four sides of a rectangular top surface. In the insert described in Wright, all four side members extend outwardly to provide the insert with a wedge shape when viewed both longitudinally and transversely to the longitudinal slot. The insert described in Joslin is wedge-shaped only when viewed longitudinally along the longitudinal slot.

Although the wedge-shaped inserts described in Wright and Joslin may be sufficient to support a concrete panel on a building structure, the disadvantage exists that cup-like metal housings of such inserts are relatively expensive to manufacture. For example, numerous operations may be required to manufacture the cup-like housing from sheet metal, including cutting or stamping, bending, and welding.

Many presently used concrete inserts have a simple U-shaped metal housing with only two downwardly extending generally rectangular side members. Compared to cup-like metal housings, U-shaped metal housings may be more simply and economically formed by stamping or cutting the top surface and side members from a single sheet of metal, followed by bending the side members downwardly. U.S. Pat. No. 1,933,536 to Awbrey shows one variant of such an insert which has a U-shaped metal housing defining a longitudinally extending channel having open ends and an open bottom.

In the Awbrey insert, the side members are rectangular and diverge away from each other downwardly and outwardly from the top surface so that the metal housing defines a wedge shape in end view only. The present inventor has appreciated that inserts having such housings typically have lower than expected resistance to the types of forces which cause withdrawal of inserts from concrete.

The present inventor has appreciated that the primary reason for this low resistance is that, as forces are applied to pull the insert from the concrete, the diverging side members are forced to bend inwardly towards each other with the side members thus bending to slide out of the slots in the concrete containing the side members without fracture of the concrete as a cone from the innermost ends of the insert. In effect, the wedge shape formed by the side members diverging away from each other progressively collapses as the insert is drawn out of the concrete by deformation of the side members towards each other and the deformation is not resisted by any structure extending between the side members other than the bight. Use of relatively thick sheet metal for the metal housing may reduce deformation somewhat, however the use of thicker sheet metal increases the cost of the insert and is therefore undesirable. Another attempted solution, shown in Awbrey, is to provide outwardly extending rectangular flanges at the bottom of the rectangular side members to improve resistance to withdrawal forces. However, it has been found that such flanges will, like the side members, bend to slide out the slots in the concrete and are not effective at resisting withdrawal. Furthermore, formation of these flanges requires at least one additional step in the manufacturing process.

Therefore, the disadvantage exists that presently known concrete inserts having U-shaped metal housings provide insufficient resistance to forces acting on wall panels and building structures, and the steps taken to improve resistance to such forces substantially increase the cost of such inserts.

Many presently known concrete inserts have the additional disadvantage that an overly complicated mechanism is used to form a concrete-free chamber beneath the top of the metal housing and retain the nut therein. This sealing and retaining mechanism typically comprises at least three parts. A first part of this mechanism comprises a sealing member having a bottom surface and two vertical end walls, the sealing member being received in the channel to enclose the nut. A second part comprises a plastic top cap which seals the longitudinal slot. Together, the sealing member and top cap prevent concrete from entering the chamber in which the nut is retained. A third part of the mechanism comprises a spring between the nut and the bottom wall of the sealing member, which biases the nut against the top of the metal housing.

This type of mechanism has the disadvantage that a number of components must be separately manufactured and subsequently assembled, thus increasing manufacturing and material costs of the insert.

SUMMARY OF THE INVENTION

The present invention overcomes the above disadvantages of the prior art by providing an improved concrete insert having a wedge-shaped metal housing of simple construction which retains its wedge shape when subjected to withdrawal forces, and by providing a simplified mechanism for providing a concrete-free chamber and retaining therein a fastener such as a nut.

It is one object of the present invention to provide a concrete insert having a U-shaped metal housing and wedge forming side members.

It is another object of the present invention to provide a concrete insert having a U-shaped metal housing and trapezoidal side members.

It is yet another object of the present invention to provide a concrete insert having a mechanism for retaining a nut and providing a concrete free chamber which comprises one or two components.

It is yet another object of the present invention to provide a concrete insert having a frangible mechanism for retaining a nut and providing a concrete free space.

It is yet another object of the present invention to provide a concrete wall panel having embedded therein a plurality of concrete inserts according to the present invention.

In particular, the present invention provides a concrete insert having a U-shaped metal housing defining a longitudinally extending channel and having a top bight portion adjoining two downwardly extending side members. Each side member of the metal housing independently forms a wedge, such that when the insert of the present invention is embedded in concrete, each side member of the housing resists withdrawal of the insert from the concrete.

The wedge shape of each side member is provided by two longitudinally spaced edges of the side member diverging downwardly from a longitudinally extending side of the bight portion. Preferably, each of the side members defines a trapezoid, more preferably a bilaterally symmetrical trapezoid.

Therefore, the wedge shape of the metal housing is provided by the shape of the individual side members. This results in the wedge being highly resistant to deformation and the metal housing retaining its wedge shape when withdrawal forces are applied to the concrete insert of the present invention.

The high resistance to deformation of the concrete insert of the present invention allows the metal housing to be of simple construction. Preferably, the housing is formed from a sheet of metal of generally uniform thickness, for example by cutting or stamping the housing from the sheet of metal, and simply bending the side members downwardly along the longitudinal sides of the bight portion.

Due to the inherent resistance to deformation provided by the shape of the side members, the metal housing of the insert of the present invention may be made from a relatively thin sheet of metal, resulting in substantial material savings.

The present invention also provides a simplified sealing and retaining mechanism to provide a concrete free space in an upper portion of the channel defined by the metal housing of the insert, and retain a nut in this space in alignment with an elongate slotted opening in the bight portion.

The sealing and retaining mechanism preferably comprises at most only two components, a sealing member and a top cap. The sealing member has several functions. Firstly, the sealing member prevents liquid concrete from flowing through the open ends and bottom of the channel into the upper portion of the channel during casting of the concrete wall panel. Secondly, the sealing member retains the nut in a position where it can be engaged by an elongate fastener such as a bolt. Thirdly, the sealing member preferably does not substantially impede longitudinal sliding of the nut along the length of the slot after the nut has been connected to an elongate fastener such as a bolt.

Therefore, the sealing member is preferably comprised of a material which is frangible or compressible, such that it can retain the nut in position and prevent concrete from filling the space in which the nut is received, but which may easily be broken and/or compressed so as not to prevent the desired longitudinal sliding of the nut after a concrete panel incorporating the insert has been attached to a building frame.

Preferably, the sealing member comprises a block of compressible and/or frangible material received in an upper portion of the channel formed by the metal housing and defines a concrete free space in which the nut is received. The sealing member preferably retains the nut in contact with the bight portion directly below the longitudinal slot so that the nut may be easily engaged by a longitudinal fastener such as a bolt.

The sealing and retaining mechanism also comprises a top cap sealingly received in the elongate, longitudinal opening of the bight portion to prevent liquid concrete from flowing through the opening in the bight portion and contacting the nut. After casting of the wall panel, the top cap is removed from the upper surface of the bight portion so that the nut is available for engagement to a fastener such as a bolt. Preferably, the top cap comprises a plug of frangible material which is easily broken and may be removed from the opening by prying and/or scraping, for example with a screwdriver.

Preferably, the sealing member and the top cap are integrally formed, for example by molding, from one piece of foam plastic, most preferably foamed polystyrene such as that sold under the trade mark Styrofoam™. Therefore, the sealing and retaining mechanism of the present invention most preferably comprises a single component comprised of inexpensive material.

In one aspect, the present invention provides a concrete insert comprising: an elongate bight portion having an upper surface and two longitudinal sides, said bight portion being adapted for connection to a fastener means; two wedge-forming, generally planar side members in spaced, facing relationship to one another, each side member extending downwardly from a respective one of said longitudinal sides of said bight portion, said side members and said bight portion together defining a U-shaped, longitudinally extending channel having an open bottom and open ends, wherein each of said side members has two longitudinally spaced, diverging edges extending downwardly from the bight portion, the two edges of each side member diverging from one another with increasing distance from said bight portion.

In another aspect, the present invention provides a concrete insert comprising: a metal housing defining a U-shaped, longitudinally extending channel having an open bottom and open ends, said metal housing comprising an elongate bight portion having an upper surface and two longitudinal sides, and two wedge-forming, generally planar side members in spaced, facing relationship to one another, said bight portion having an elongate, longitudinal slot therethrough adapted to receive elongate fastening means, each side member extending downwardly from a respective one of said longitudinal sides of said bight portion; nut means located in said channel and having a threaded aperture accessible to a threaded end of said elongate fastening means, said nut means adapted to secure said elongate fastening means to said bight portion; a sealing member received in said channel, said sealing member comprising a longitudinally extending bottom surface sealing said open bottom of said channel below said nut means, end surfaces extending upwardly from said bottom surface and sealing said open ends of said channel, and a chamber enclosed by said bottom surface and end surfaces in which said nut means is retained; and a top cap sealingly received in said elongate, longitudinal slot, said top cap being removable upwardly from said upper surface of said bight portion.

In yet another aspect, the present invention provides a concrete building wall panel having a rear surface in which are embedded in spaced relation a plurality of concrete inserts, each of said concrete inserts comprising: a metal housing defining a U-shaped, longitudinally extending channel having an open bottom and open ends, said metal housing comprising an elongate bight portion having two longitudinal sides and an upper surface substantially flush with the rear surface of the wall panel, and two wedge-forming, generally planar side members each extending downwardly from a respective one of said longitudinal sides of said bight portion and embedded in said wall panel in spaced, facing relationship to one another, said bight portion having an elongate, longitudinal slot therethrough adapted to receive elongate fastening means; nut means located in said channel and having a threaded aperture accessible to a threaded end of said elongate fastening means, said nut means adapted to secure said elongate fastening means to said bight portion; a sealing member received in said channel, said sealing member comprising a longitudinally extending bottom surface sealing said open bottom of said channel below said nut means, end surfaces extending upwardly from said bottom surface and sealing said open ends of said channel, and a concrete-free chamber enclosed by said bottom surface and end surfaces in which said nut means is retained; and a top cap sealingly received in said elongate, longitudinal slot, said top cap being removable upwardly from said upper surface of said bight portion.

BRIEF DESCRIPTION OF THE DRAWINGS

Further aspect and advantages of the present invention will become apparent from the following description, taken together with the accompanying drawings, in which.

DETAILED DESCRIPTION OF THE PREFERRED EMBODIMENTS

A preferred concrete insert according to the present invention is now described below with reference to FIGS. 1 to 4.

Figure 1:
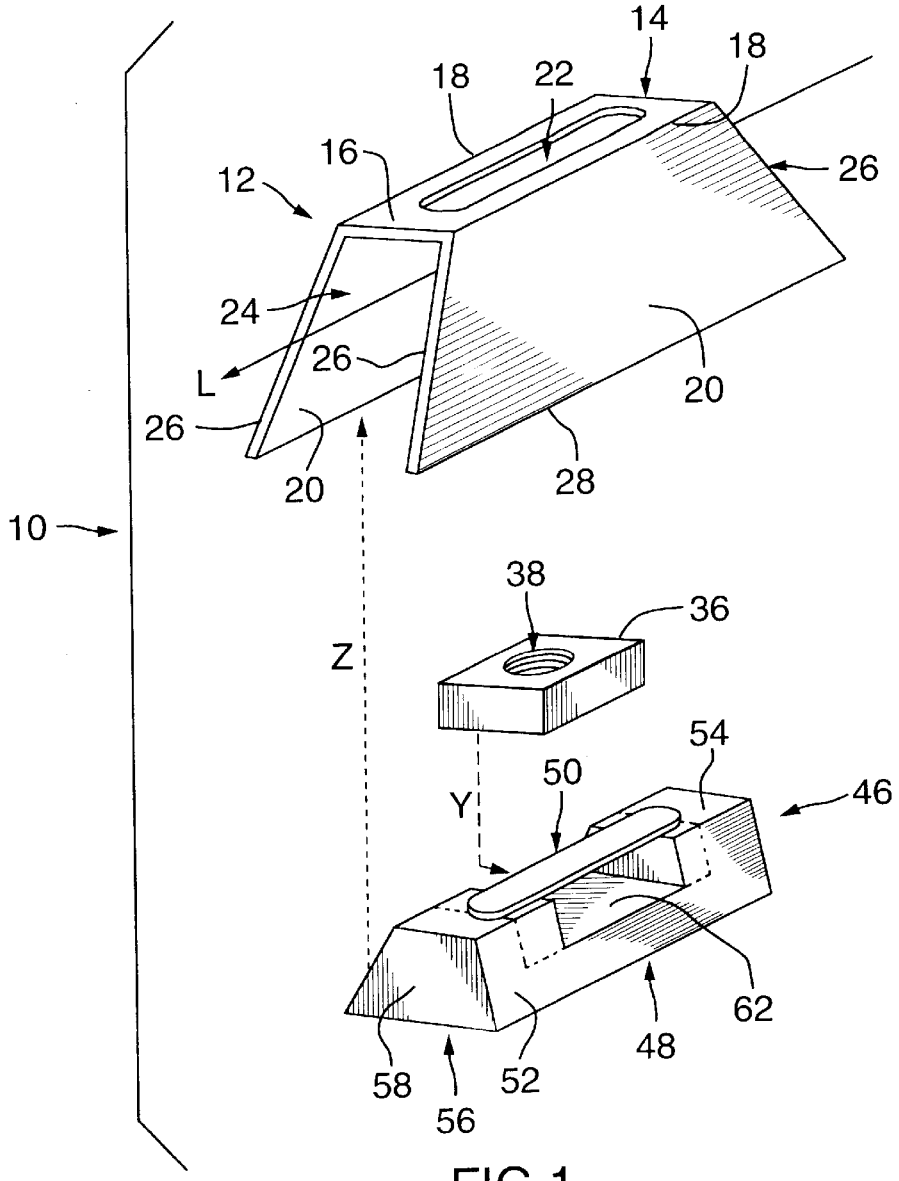
FIG. 1 is an exploded perspective view of a preferred concrete insert according to the present invention.

FIG. 1 is an exploded view of a preferred concrete insert 10 according to the present invention. Insert 10 has a metal housing 12 comprising a rectangular, elongate bight portion 14 having an upper surface 16 and two longitudinal sides 18, and two wedge-forming, generally planar side members 20 in spaced, facing relationship to one another, each side member 20 extending downwardly from one longitudinal side 18 of bight portion 14. An elongate, longitudinal opening 22 is provided through bight portion 14.

The metal housing 12 of insert 10 defines a longitudinally extending channel 24 along longitudinal axis L, the housing 12 being U-shaped in a plane transverse to longitudinal axis L. In the preferred embodiment shown in FIG. 1, side members 20 and elongate, longitudinal opening 22 are also parallel to longitudinal axis L.

Each of the side members 20 independently forms a wedge having two longitudinally spaced, diverging edges 26 extending downwardly from bight portion 14, the edges 26 diverging with increasing distance downwardly from bight portion 14.

Each side member 20 is preferably trapezoidal in shape, such that each diverging edge 26 extends downwardly at an obtuse angle from one longitudinal side 18 of bight portion 14 to bottom edge 28 of side member 20, the bottom edge 28 being parallel to and longer than the longitudinal side 18 of bight portion 14.

Figure 2:
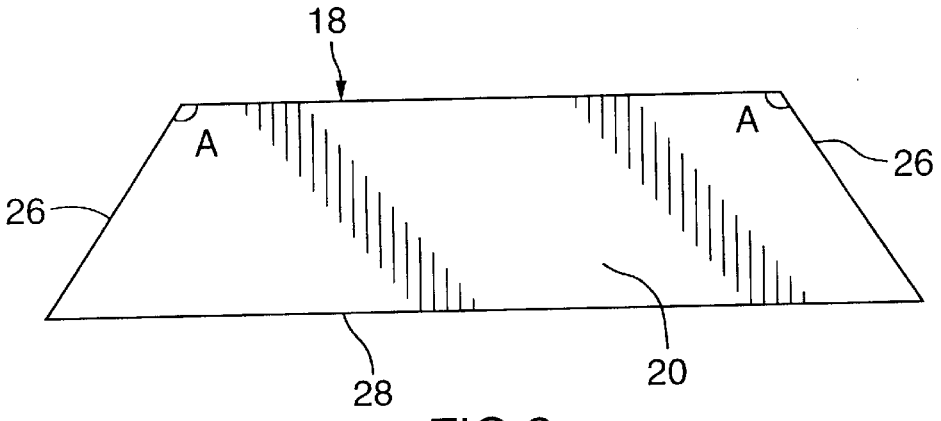
FIG. 2 is a side elevation view of the concrete insert of FIG. 1.

As best seen in the side view of FIG. 2, side member 20 most preferably defines a bilaterally symmetrical trapezoid in which both diverging edges 26 extend downwardly at the same obtuse angle A from longitudinal side 18 of bight portion 14. Preferably, obtuse angle A is from about 110° to about 150°.

Figure 3:
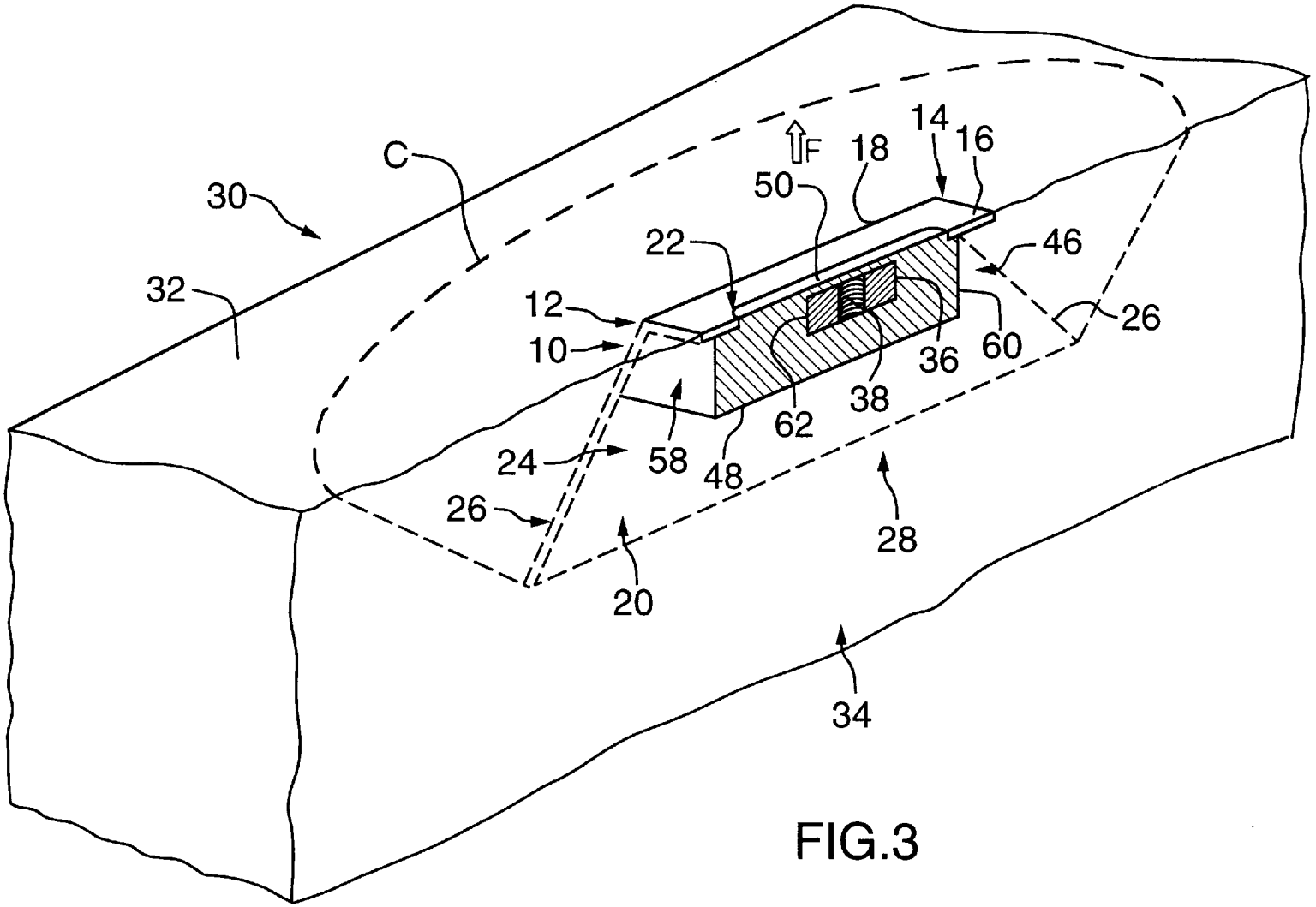
FIG. 3 is a perspective view, partly in cross section, of the concrete insert of FIG. 1 embedded in a concrete wall panel.

FIG. 3 is a cross sectional view along longitudinal axis L showing preferred concrete insert 10 embedded in a wall panel 30 comprised of concrete 34 and having a rear surface 32 adapted to be connected to a building frame (not shown). As shown in FIG. 3, bight portion 14 may preferably be coplanar, or flush, with the rear surface 32 of wall panel 30, and side members 20 are preferably completely embedded in the concrete 34 comprising wall panel 30, such that diverging edges 26 of side member 20 diverge from one another in a direction away from the rear surface 36 of wall panel 32. Although not shown in FIG. 3, insert 10 may be embedded in wall panel 30 with bight portion 14 slightly recessed relative to rear surface 32 of wall panel 30.

Although FIG. 3 shows only a portion of concrete wall panel 30 containing one insert 10, it is to be understood that a plurality of inserts 10 would be embedded in rear surface 32 of wall panel 30 in spaced relation to one another and sufficient in number to substantially completely resist lateral forces acting on wall panel 30 when wall panel 30 is connected to the building frame.

Arrow F in FIG. 3 represents a lateral force applied to insert 10 directed outwardly from rear surface 32 of wall panel 30. If force F is great enough, wall panel 30 will fracture in a conical pattern represented by dashed lines C emanating outwardly and upwardly from bottom edge 28 of side member 20 to rear surface 32 of wall panel 30, resulting in withdrawal of insert 10 from wall panel 30. The wider the base of insert 10, the larger the fracture cone C and the greater will be force F required to withdraw insert 10. As is known, the angle of the cone is dependent on the particular concrete composition in the slab.

As shown in FIG. 3, diverging edges 26 of each side member 20 are longitudinally separated by the solid, planar piece of metal which comprises that side member 20. Each side member 20 forms an independent wedge. Force F acting on the insert 10 will be opposed by forces acting on each edge 26 of the side member 20, with equal and opposite forces acting on each edge 26. These forces will notably attempt to compress the side member 20 in a longitudinal direction and such longitudinal compressive forces are resisted by reason of the side member 20 forming a structural beam in the longitudinal direction between edges 26. Therefore, application of force F to insert 10 will not substantially cause deformation of each side member 20 from its trapezoidal shape such that conceptually there is no effective reduction in obtuse angle A.

Since side member 20 maintains its wedge shape when force F is applied, the size of fracture cone C is not substantially reduced during application of force F. Therefore, insert 10 will maintain its original degree of resistance to lateral forces such as force F over an extended period of time.

Figure 4:
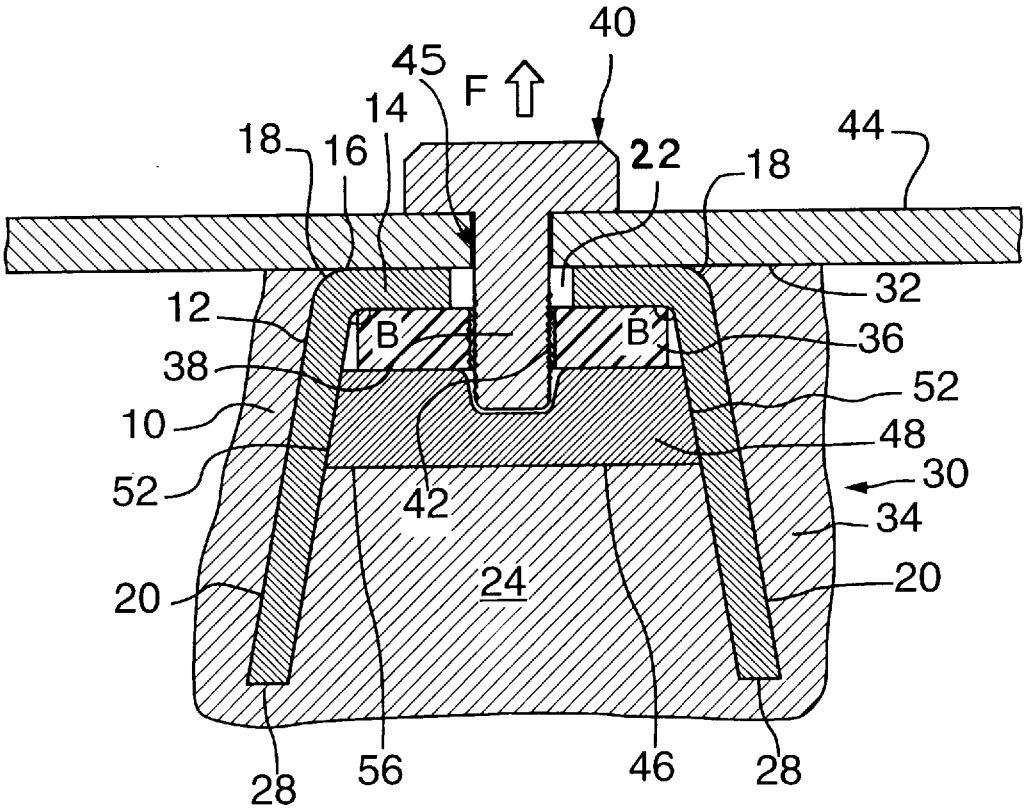
FIG. 4 is an end elevation view of the concrete insert of FIG. 1 embedded in a concrete wall panel.

As best seen in the end view of FIG. 4, the side members 20 of insert 10 preferably diverge outwardly relative to one another downwardly of the bight portion 14. In this preferred embodiment, metal housing 12 defines a wedge shape in two dimensions, with the shape of the side members 20 providing a wedge along longitudinal axis L and the relative orientation of the side members 20 providing a wedge shape transverse to longitudinal axis L. Most preferably, both side members 20 diverge downwardly from bight portion 14 at the same obtuse angle B, which is from greater than 90° to about 120°. The relative divergence of side members 20 increases the area of fracture cone C and therefore provides increased resistance to withdrawal.

Although preferred insert 10 has been described as having diverging side members 20, it is to be understood that angle B may be 90° so that side members 20 are parallel to one another and do not diverge. It is to be appreciated that the wedge shape of each side member 20 provides insert 10 with sufficient resistance to withdrawal from concrete wall panel 30.

Since metal housing 12 of insert 10 has a simple U-shape, it may preferably be formed from a sheet of metal of generally uniform thickness. For example, the bight portion 14 and side members 20 may be cut or stamped from the sheet of metal, followed by bending the sheet of metal along the longitudinal sides of the bight portion to form the U-shaped, longitudinally extending channel 24.

Preferably, the sheet metal comprises a corrosion resistant steel such as stainless steel or mild steel which has been galvanized or otherwise protected against corrosion. Preferably, the sheet metal has sufficient thickness such that neither side members 20 nor bight portion 14 will bend or buckle when acted upon by "design" forces, that is lateral forces typically acting on wall panels mounted to building structures. Preferably, the thickness of the sheet metal is about ⅛ inch to about ¼ inch.

The following is a discussion of the improved system provided by the present invention for providing a concrete free space in the longitudinal channel 24 and retaining a fastener therein, the fastener preferably being a nut.

As best shown in FIG. 3, the preferred insert 10 of the present invention includes a nut 36 having a threaded aperture 38. As shown in FIG. 4, nut 36 is located in an upper portion of channel 24 such that threaded aperture 38 is accessible to an elongate fastener such as bolt 40, having a threaded end 42 extending through elongate, longitudinal opening 22. Bolt 40 is threaded into aperture 38 of nut 36, thereby securely connecting bight portion 14 of insert 10 to a structural member 44 of a building structure.

Preferably, nut 36 is received in channel 24 substantially against rotation about aperture 38. To prevent rotation of nut 36 as insert 10 is connected to structural member 44 by bolt 40, nut 36 is preferably sized and shaped to be closely received in chamber 24. Furthermore, although nut 36 is shown in FIG. 1 as being square, nut 36 may have any convenient shape which allows it to be received against substantial rotation in chamber 24. For example, nut 36 may also preferably be hexagonal in shape.

Preferably, nut 36 is retained in contact with bight portion 14 with its aperture 38 directly below opening 22, thus providing easy access to bolt 40.

After installation of wall panel 30 incorporating inserts 10, nut 36 is preferably slidable along elongate, longitudinal opening 22. As discussed above, slidability of nut 36 helps to prevent damaging stresses from developing in panel 30 due to thermal expansion and contraction of the concrete panel 30 relative to the building frame or vice versa, seismic activity or wind induced building shape changes. Furthermore, it is preferred that concrete does not fill the aperture 38 of nut 36 during casting of panel 30.

Therefore, during casting of concrete panel 30, liquid concrete is preferably prevented from entering a space in the upper portion of channel 24 in which nut 36 is received. This concrete free space preferably extends downwardly from bight portion 14 to below nut 36 and extends longitudinally along most or all of the length of longitudinal opening 22.

In a most preferred embodiment of the present invention, nut 36 is retained and the concrete free space is formed by a single component, comprising nut retaining block 46, best illustrated in FIGS. 1 and 3. Block 46 has a lower sealing member portion 48 and an upper top cap portion 50, between which nut 36 is received.

As shown in FIG. 1, sealing member portion 48 is shaped to be closely received in the upper portion of channel 24 immediately below bight portion 14. The side surfaces 52 and top surface 54 are preferably adhesively, sealingly received against the side members 20 and bight portion 14 of metal housing, respectively. For example, an adhesive may be applied to side surfaces 52 and top surface 54, or sealing member 48 may be molded in situ in channel 24 and of a material which will inherently on setting bond to the channel 24. Sealing member 48 may also be received in channel 24 in a friction fit.

The sealing member 48 also has a longitudinally extending bottom surface 56 sealing the open bottom of channel 24 below the nut 36, and two end surfaces 58 extending upwardly from the bottom surface 56 and sealing the open ends of channel 24. The bottom surface 56 and side surfaces 52 of sealing member 48 together define the concrete free space 60 into which concrete is prevented from entering during casting of wall panel 30.

Nut 36 is received in a chamber 62 formed in the sealing member 48. As shown in FIG. 1, chamber 62 may preferably be sized to closely receive nut 36 against substantial vertical movement relative to bight portion 14, and also against substantial longitudinal movement along longitudinal opening 22.

However, during installation of panel 30 on a building frame, it may be preferred that nut 36 is free to slide longitudinally along opening 22 to assist in aligning nut 36 relative to a fastener such as bolt 40. It is to be appreciated that due to dimensional discrepancies in the wall panel 30 and in the building structure itself, it may be preferred that longitudinal sliding of nut 36 is possible. Therefore, as indicated by dashed lines in FIG. 1, chamber 62 may preferably be elongate to permit some sliding movement of nut 36 along longitudinal opening 22.

The sealing member 48 may preferably be at least partially displaced by longitudinal movement of the nut 36 along opening 22 after panel 30 incorporating insert 10 is attached to a building frame. The displacement of sealing member 48 is preferably caused by breaking and/or compression of sealing member 48. Therefore, the material from which sealing member is formed is preferably frangible and/or compressible in response to longitudinal movement of nut 36 caused by forces such as thermal expansion or contraction, seismic activity or wind.

Preferred frangible and/or compressible materials include fibrous materials, such as paper or wood based materials, for example cardboard, paper mâché, bound particles of sawdust, bound wood chips; plaster or mortar-like materials; polymeric materials such as foamed plastics and breakable plastics. The sealing member may either comprise a solid "block" of frangible and/or compressible material, or may be hollow with the frangible and/or compressible material defining a hollow space. Virtually any frangible and/or compressible material may be used which will create a concrete free space and which will retain the nut in position until it is engaged by a fastener such as bolt 40.

The upper top cap portion 50 of block 46 is preferably a thin, flexible elongate strip of material sized and shaped to be sealingly received in elongate, longitudinal opening 22 and thereby prevent liquid concrete from flowing through opening 22 into concrete free space 60 during casting of wall panel 30. Preferably, top cap 50 does not substantially protrude above upper surface 16 of bight portion 14.

Top cap 50 is preferably attached to upper surface 54 of sealing member 48, for example by adhesive, or block 46 comprising sealing member 48 and top cap 50 may be integrally formed, for example by molding.

Top cap 50 is preferably removed from opening 22 after the concrete 34 comprising panel 30 has set, thereby allowing aperture 38 of nut 36 to be accessible to a bolt 40 or other fastener. Top cap 50 is preferably removed upwardly from upper surface 16 of bight portion 14, for example by prying the top cap 50 from opening 22 with a screwdriver or the like. Therefore, top cap 50 is preferably comprised of a material which is frangible. Top cap 50 may be comprised of any of the frangible materials listed above, and is more preferably comprised of a polymeric material such as an easily broken strip of plastic, either foamed or unfoamed.

In a most preferred embodiment of the present invention, both sealing member 48 and top cap 50 are comprised of a semi-rigid, compressible material such as foamed plastic, more preferably foamed polystyrene, and most preferably expanded, cellular, foamed polystyrene such as that sold under the trade mark Styrofoam™.

In order to assemble the insert 10 of the present invention, nut 36 is simply slid horizontally into chamber 62 as indicated by arrow Y of FIG. 1, and the nut 26/block 46 assembly is adhesively secured in channel 24 as indicated by arrow Z in FIG. 1.

Wall panels such as panel 30 to be incorporated into curtain walls of buildings are typically formed by pouring liquid concrete or other cementitious material into a mold or form, allowing the concrete to harden and then removing the cast wall panel from the mold or form.

In the method of the present invention, either before or after the liquid concrete is poured into the mold or form, a plurality of inserts 10 are positioned at the rear surface 32 of the wall panel 30 at predetermined locations and in spaced relation to one another. For example, the inserts 10 may be held in place in a known manner in the form or mold prior to pouring the concrete. Alternatively, inserts 10 may be embedded in the concrete after pouring and while the concrete remains in a liquid condition. Therefore, the mold or form is preferably configured so that the wall panel 30 has its front surface (not shown) facing downwardly, and the opposite rear surface 32 directed upwardly and exposed. The rear surface 32 may be smoothed, as by screeding, and the concrete may be vibrated to remove air bubbles, either before or after insertion of the inserts 10.

The location and number of concrete inserts 10 must be sufficient to connect the wall panel 30 to one or more structural members 38 of the building structure such that lateral forces acting on wall panel 30 may be completely or substantially completely resisted only by the inserts 10.

The inserts 10 of the present invention are preferably located in the liquid concrete of wall panel 30 so that bight portion 14 is coplanar or slightly recessed relative to the rear surface 32 of wall panel 30 and so that side members 20 become completely embedded in the liquid concrete. Furthermore, the inserts 10 are preferably spaced over the rear surface 32 to maximize their ability to compensate for movement, expansion and contraction of the panel 30 after it is installed on the building frame. Therefore, some of the inserts are preferably located in the liquid concrete in an orientation such that when the wall panel 30 is mounted vertically on a building frame, the longitudinal opening 22 in bight portion 14 extends vertically. Other of the inserts 10 are preferably mounted with the opening 22 directed horizontally. This permits either vertical or horizontal movement or expansion of panel 30 to be compensated for by movement of nut 36 along opening 22 of insert 10. It may also be preferable to provide one or more inserts 10 in which the opening 22 is directed diagonally.

Preferably, the concrete-free space 60 and the longitudinal opening 22 are of sufficient length that extremes in expansion and contraction or other movement of the wall panel 30 may be offset by longitudinal displacement of nut 36. Furthermore, the longitudinal opening 22 compensates for dimensional discrepancies of manufacturing by allowing nut 36 to be moved into alignment with a fastener during installation of wall panel 30.

After the concrete sets, wall panel 30 is removed from the mold or form and is preferably allowed to cure before being mounted on a building structure. Furthermore, the wall panel may be subjected to one or more finishing operations prior to mounting.

A method of mounting wall panel 30 to the frame of a building structure is now described below.

After wall panel 30 is transported to the building site, and prior to mounting wall panel 30, the frangible top cap 50 is preferably removed from the opening 22 in the bight portion 14 of each insert 10. This exposes nut 36, the aperture 38 of which is preferably aligned with opening 22. Because top cap 50 is preferably made of a frangible material, it may easily be broken and removed from opening 22, as for example with a screwdriver.

After removing the top cap 50 from each insert 10, wall panel 30 is raised to the location where it will be attached to the building frame. Once at this location, each insert 10 is securely coupled to a structural member 44 of the building frame by bolt 40. For example as shown in FIG. 4, the structural member 44 may preferably be provided with a hole 45 through which bolt 40 extends to the insert 10.

Although FIG. 4 illustrates structural member 44 being bolted to insert 10 through a hole 45, it is to be appreciated that numerous other methods exist for coupling insert 10 to a building frame. Any suitable method may be used in which a fastener having a threaded shaft threadingly engages nut 36 and thereby securely couples insert 10 to the building frame.

In the embodiment shown in FIG. 4, bolt 40 is tightened until bight portion 14 of insert 10 and rear surface 32 of wall panel are received against movement relative to structural member 38. The shaft 42 of bolt 40 is shown in FIG. 4 as having been threaded through nut 36 and extending into sealing member 48. Since sealing member 48 is frangible and/or compressible, it is easily compressed and/or broken by the shaft 42 of bolt 40, and therefore bolt 40 encounters little resistance due to sealing member 48. The depth of concrete-free space 60 is preferably sufficient that bolt 40 will not pass completely through space 60 and encounter concrete 34 of wall panel 30.

Although not shown in FIG. 3, it is to be understood that spacers or washers may be provided between the rear surface 32 of wall panel 30 and structural member 44.

Although not shown in the drawings, it is to be understood that the side members 20 of insert 10 may preferably be provided with holes to receive reinforcing rods or the like therethrough.

Although the insert of the present invention has been described as being useful for mounting vertical wall panels on building frames, it is to be understood that the inserts of the present invention may also be embedded into any objects cast from concrete or other cementitious materials and may be used to attach such cast objects to any type of structural member, which may or may not be part of a building frame.

Although a preferred embodiment of the invention has been described in terms of a concrete insert 10 which is connected to a building structure by an attachment mechanism comprising a nut 36 received in chamber 24, it is to be appreciated that the wedge-shaped side members described herein are not restricted to use with such an insert 10. Rather, wedge-shaped side members as described herein may be used in any type of concrete insert having any type of connection mechanism. For example, wedge-shaped side members may be used in an insert having an attachment mechanism as shown in the above-mentioned Joslin patent, FIG. 5 of U.S. Pat. No. 4,194,333 to Paton et al., or that shown in the drawings of U.S. Pat. No. 4,905,444 to Semaan et al.

It is to be appreciated that the nut retaining block 46 of the present invention may be used in any type of concrete insert having a U-shaped metal housing with a bight portion and downwardly extending side members, wherein an elongate, longitudinal slot is formed in the bight portion and a nut or other fastener is received under the bight portion, and is not restricted to use in concrete insert 10 described above.

Conversely, it is to be appreciated that a concrete insert having metal housing 12 and nut 36 according to the present invention may be provided with a nut retaining mechanism other than nut retaining block 46. For example, an insert according to the present invention may be provided in which nut 36 is retained by a three piece mechanism such as that described above comprising a plastic sealing member having a bottom surface and two vertical end walls which is received in the channel to enclose the nut 36, a plastic top cap which seals the longitudinal slot 22, and a spring received between the nut 36 and the bottom wall of the sealing member, biasing the nut 36 against the bight portion 14.

Although the invention has been described in connection with certain preferred embodiments, it is not intended that it be limited thereto. Rather, it is intended that the invention cover all alternate embodiments as may be within the scope of the following claims.

I claim:

1. A concrete insert, comprising:

an elongate bight portion having an upper surface and two longitudinal sides, said bight portion being adapted for connection to a fastener means; and two generally planar side members, each having an inner face and an outer face, with said inner faces of said two side members being in spaced, facing relationship to one another, each of said side members extending downwardly from a respective one of said longitudinal sides of said bight portion, said side members being connected to one another only through said bight portion so that said side members and said bight portion together define a U-shaped, longitudinally extending channel having an open bottom and open ends, wherein each of said side members is wedge-shaped, having two longitudinally spaced, diverging end surfaces extending between said inner and outer faces and extending downwardly from the bight portion, the two end surfaces of each said side member diverging from one another with increasing distance from said bight portion.

2. The concrete insert of claim 1, wherein said side members and said bight portion are formed from a sheet of metal of generally uniform thickness.

3. The concrete insert of claim 2, wherein said sheet of metal has a thickness of from about ⅛ inch to about ¼ inch, and is comprised of stainless steel or galvanized mild steel.

4. The concrete insert of claim 2, wherein said side members and said bight portion are formed into said U-shaped, longitudinally extending channel by bending said sheet of metal along said longitudinal sides of said bight portion.

5. The concrete insert of claim 1, wherein each of said side members defines a trapezoid with each of the two diverging end surfaces of the side member extending downwardly at an obtuse angle from one of the longitudinal sides of the bight portion to a bottom edge of the side member, the bottom edge of the side member being longer than and parallel to the longitudinal side of the bight portion.

6. The concrete insert of claim 5, wherein each side member defines a bilaterally symmetrical trapezoid.

7. The concrete insert of claim 1, wherein said side members diverge from one another downwardly from said bight portion.

8. The concrete insert of claim 1, wherein said bight portion has an opening therethrough adapted to receive elongate fastening means.

9. The concrete insert of claim 8, wherein said opening in said bight portion comprises an elongate, longitudinal slot.

10. The concrete insert of claim 9, additionally comprising nut means located in said channel and having a threaded aperture accessible to a threaded end of said elongate fastening means, said nut means adapted to secure said elongate fastening means to said bight portion.

11. The concrete insert of claim 10, additionally comprising a sealing member received in said channel, said sealing member comprising:

a longitudinally extending bottom surface sealing said open bottom of said channel below said nut means, end sealing surfaces extending upeardly from said bottom surface and sealing said open ends of said channel, and a chamber enclosed by said bottom surface and end sealing surfaces in which said nut means is retained.

12. A concrete insert, comprising:

an elongate bight portion having an upper surface and two longitudinal sides, said bight portion having an opening therethrough adapted to receive elongate fastening means, said opening comprising an elongate, longitudinal slot;

two generally planar side members in spaced, facing relationship to one another, each side member extending downwardly from a respective one of said longitudinal sides of said bight portion, said side members and said bight portion together defining a U-shaped, longitudinally extending channel having an open bottom and open ends, wherein each of said side members is wedge-shaped, having two longitudinally spaced, diverging edges extending downwardly from the bight portion, the two edges of each said side member diverging from one another with increasing distance from said bight portion;

nut means located in said channel and having a threaded aperture accessible to a threaded end of said elongate fastening means, said nut means adapted to secure said elongate fastening means to said bight portion;

a sealing member received in said channel, said sealing member comprising a longitudinally extending bottom surface sealing said open bottom of said channel below said nut means, end surfaces extending upwardly from said bottom surface and sealing said open ends of said channel, and a chamber enclosed by said bottom surface and end surfaces in which said nut means is retained, wherein said sealing member comprises a block of semi-rigid, compressible material, and said chamber is sized to prevent substantial movement of said nut means transverse to the elongate, longitudinal slot.

13. The concrete insert of claim 12, wherein said chamber of said sealing member is elongate to permit movement of said nut means along the elongate, longitudinal slot.

14. The concrete insert of claim 12, wherein said semi-rigid, compressible material comprises foam plastic.

15. The concrete insert of claim 14, wherein said block of foam plastic is retained in said channel by adhesive or a friction fit.

16. The concrete insert of claim 12, additionally comprising a top cap sealingly received in said elongate, longitudinal slot, said top cap being removable upwardly from said upper surface of said bight portion.

17. The concrete insert of claim 16, wherein said top cap comprises a plug of semi-rigid, compressible material.

18. A concrete insert, comprising:

an elongate bight portion having an upper surface and two longitudinal sides, said bight portion having an opening therethrough adapted to receive elongate fastening means, said opening comprising an elongate, longitudinal slot;

two generally planar side members in spaced, facing relationship to one another, each side member extending downwardly from a respective one of said longitudinal sides of said bight portion, said side members and said bight portion together defining a U-shaped, longitudinally extending channel having an open bottom and open ends, wherein each of said side members is wedge-shaped, having two longitudinally spaced, diverging edges extending downwardly from the bight portion, the two edges of each said side member diverging from one another with increasing distance from said bight portion;

nut means located in said channel and having a threaded aperture accessible to a threaded end of said elongate fastening means said nut means adapted to secure said elongate fastening means to said bight portion;

a sealing member received in said channel, said sealing member comprising a longitudinally extending bottom surface sealing said open bottom of said channel below said nut means, end surfaces extending upwardly from said bottom surface and sealing said open ends of said channel, and a chamber enclosed by said bottom surface and end surfaces in which said nut means is retained, wherein said sealing member comprises a block of semi-rigid, compressible material, and said chamber is sized to prevent substantial movement of said nut means transverse to the elongate, longitudinal slot; and a top cap sealingly received in said elongate, longitudinal slot, said top cap comprising a plug of semi-rigid, compressible material and being removable upwardly from said upper surface of said bight portion.

19. The concrete insert of claim 18, wherein said sealing member and said top cap are unitarily molded from foam plastic and said chamber comprises a slot between said top cap and said sealing member.

20. The concrete insert of claim 19, wherein said top cap has an upper surface which is substantially flush with the upper surface of the bight portion.

21. A concrete insert, comprising:

a metal housing defining a U-shaped, longitudinally extending channel having an open bottom and open ends, said metal housing comprising an elongate bight portion having an upper surface and two longitudinal sides, and two generally planar side members extending downwardly from a respective one of said longitudinal sides of the bight portion, each side member having an inner face and and outer face, with said inner faces of said two side members in spaced, facing relationship to one another, said bight portion having an elongate, longitudinal slot therethrough adapted to receive elongate fastening means, each said side member being wedge-shaped having two longitudinally spaced, diverging end surfaces extending between said inner and outer faces downwardly from said bight portion, the two end surfaces of each side member diverging from one another with increasing distance from said bight portion;

nut means located in said channel and having a threaded aperture acdessible to a threaded end of said elongate fastening means, said nut means adapted to secure said elongate fastening means to said bight portion;

a sealing member received in said channel, said sealing member comprising a longitudinally extending bottom surface sealing said open bottom of said channel below said nut means, end sealing surfaces extending upwardly from said bottom surface and sealing said open ends of said channel, and a chamber enclosed by said bottom surface and end sealing surfaces in which said nut means is retained; and a top can sealingly received in said elongate, longitudinal slot, said top cap being removable upwardly from said upper surface of said bight portion.

22. A concrete insert, comprising:

a metal housing defining a U-shaped, longitudinally extending channel having an open bottom and open ends, said metal housing comprising an elongate bight portion having an upper surface and two longitudinal sides, and two generally planar side members in spaced, facing relationship to one another, said bight portion having an elongate, longitudinal slot therethrough adapted to receive elongate fastening means, each side member being wedge-shaped and extending downwardly from a respective one of said longitudinal sides of said bight portion:

nut means located in said channel and having a threaded aperture accessible to a threaded end of said elongate fastening means, said nut means adapted to secure said elongate fastening means to said bight portion;

a sealing member received in said channel, said sealing member comprising a longitudinally extending bottom surface sealing said open bottom of said channel below said nut means, end surfaces extending upwardly from said bottom surface and sealing said open ends of said channel, and a chamber enclosed by said bottom surface and end surfaces in which said nut means is retained, wherein said sealing member comprises a block of semi-rigid, compressible material and said chamber is sized to prevent substantial movement of said nut means transverse to the elongate, longitudinal slot; and a top cap sealingly received in said elongate, longitudinal slot, said top cap being removable upwardly from said upper surface of said bight portion.

23. The concrete insert of claim 22, wherein said top cap comprises a plug of semi-rigid, compressible material.

24. The concrete insert of claim 23, wherein said sealing member and said top cap are unitarily molded from foam plastic and said chamber comprises a slot between said top cap and said sealing member.

25. The concrete insert of claim 24, wherein each side member defines a bilaterally symmetrical trapezoid having two diverging edges of the side member extending downwardly at an obtuse angle from one of the longitudinal sides of the bight portion to a bottom edge of the side member, the bottom edge of the side member being longer than and parallel to the longitudinal side of the bight portion.

26. A concrete building wall panel having a rear surface in which are embedded in spaced relation a plurality of concrete inserts, each of said concrete inserts comprising:

a metal housing defining a U-shaped, longitudinally extending channel having an open bottom and open ends, said metal housing comprising an elongate bight portion having two longitudinal sides and an upper surface substantially flush with the rear surface of the wall panel, and two generally planar side members, each of said side members being wedge-shaped and extending downwardly from a respective one of said longitudinal sides of said bight portion and embedded in said wall panel, each of the side members having an inner face and an outer face with the inner faces of the two side members being in spaced, facing relationship to one another, each of said side members having two longitudinally spaced, diverging end surfaces extending between said inner and outer faces and extending between said inner and outer faces and downwardly from the bight portion, the two end surfaces of each side member diverging from one another with increasing distance from said bight portion, said bight portion having an elongate, longitudinal slot therethrough adapted to receive elongate fastening means;

nut means located in said channel and having a threaded aperture acdessible to a threaded end of said elongate fastening means, said nut means adapted to secure said elongate fastening means to said bight portion;

a sealing member received in said channel, said sealing member comprising a longitudinally extending bottom surface sealing said open bottom of said channel below said nut means, end sealing surfaces extending upwardly from said bottom surface and sealing said open ends of said channel, and a concrete-free chamber enclosed by said bottom surface and end sealing surfaces in which said nut means is retained; and a top can sealingly received in said elongate, longitudinal slot, said top cap being removable upwardly from said upper surface of said bight portion.

* * * * *